United States Patent [19]

Sidlinger

[11] 3,983,585

[45] Oct. 5, 1976

[54] CONCEALED SPRING ANCHORING MEANS FOR TRAMPOLINES AND METHOD OF PRODUCING SAME

[76] Inventor: Bruce C. Sidlinger, 208-214 International Road, Garland, Tex. 75040

[22] Filed: Apr. 10, 1975

[21] Appl. No.: 566,734

Related U.S. Application Data

[60] Division of Ser. No. 370,681, June 18, 1973, Pat. No. 3,891,208, which is a continuation-in-part of Ser. No. 201,376, Nov. 23, 1971, Pat. No. 3,767,009.

[52] U.S. Cl. ..... 5/317 R; 182/139; 272/65; 5/354

[51] Int. Cl.[2] ..... A47C 21/00; A63B 5/18

[58] Field of Search ..... 182/138, 139; 272/65; 297/452; 5/317, 210, 211, 286, 354, 345 R, 360, 187, 82

[56] References Cited

UNITED STATES PATENTS

| | | | |
|---|---|---|---|
| 2,871,925 | 2/1959 | Richardson | 5/360 |
| 3,050,746 | 8/1962 | Mikesell | 182/139 |
| 3,085,260 | 4/1963 | Caldemeyer et al. | 5/360 |
| 3,233,895 | 2/1966 | Grelle et al. | 182/139 |
| 3,767,009 | 10/1973 | Sidlinger | 272/65 X |
| 3,891,208 | 6/1975 | Sidlinger | 272/65 |

*Primary Examiner*—Casmir A. Nunberg
*Attorney, Agent, or Firm*—George H. Mitchell, Jr.

[57] ABSTRACT

Cushioning pads are placed along the sides of a trampoline and have sufficient width to cover the ordinarily exposed springs. The sides of the trampoline frame are reinforced by an extra tube which assists in supporting the pads out of frictional contact with the springs.

10 Claims, 9 Drawing Figures

FIG. 4
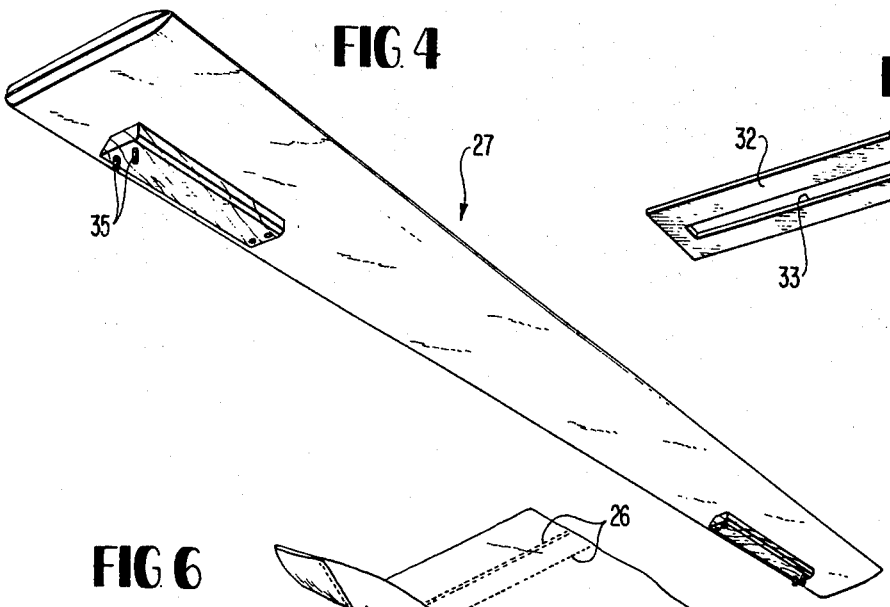
FIG. 5
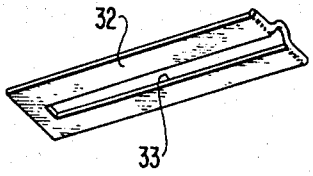
FIG. 6
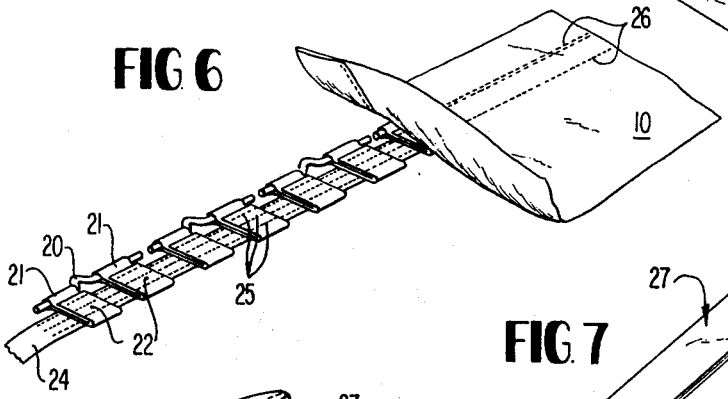
FIG. 7
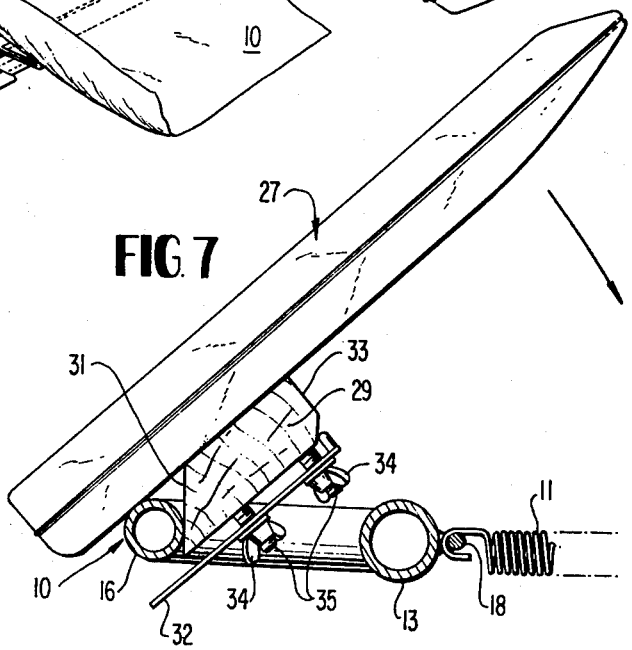
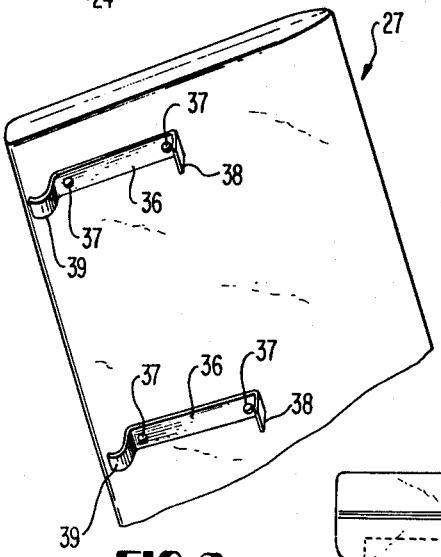
FIG. 8
FIG. 9
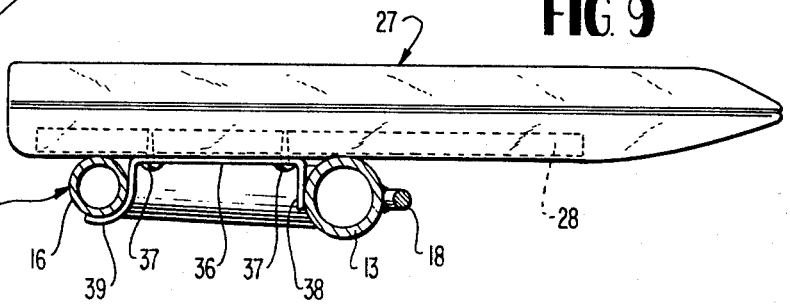

CONCEALED SPRING ANCHORING MEANS FOR TRAMPOLINES AND METHOD OF PRODUCING SAME

This application is a division of my copending application 370,681, filed June 18, 1973, now U.S. Pat. No. 3,891,208 entitled Concealed Spring Anchoring Means for Trampolines and Method of Producing Same, which is a continuation-in-part of my application Ser. No. 201,376, filed Nov. 23, 1971, entitled TRAMPOLINE SUPPORT AND CUSHIONING MEANS, now U.S. Pat. No. 3,767,009, granted Oct. 23, 1973.

The invention relates to recreational equipment and more particularly to trampolines of the type in which a flexible sheet of material is suspended horizontally by a series of coil springs connected between the margins of the sheet of material and an encircling supporting frame.

In the normal course of use by an acrobat who is not attempting to perform a feat which is beyond the scope of his proficiency, there is little danger of accident so long as the materials of the trampoline have not become worn or deteriorated and so long as the acrobat takes care to land with both feet on the bed.

As a practical matter, there are only two common ways in which a person can be injured by the springs which support the bed. Normally these springs are at least partially covered by a pad, but even when the coils of the springs are not completely covered the usual type of injuries caused by the springs result from a situation in which one end of a spring pulls away from the bed. In that case, a person's leg may become pinched between adjacent turns of a coil when it is released; normally no pinching will take place because the coils remain spread as long as they are hooked up between the frame and the bed. Another possible cause of injuries results when a spring completely pulls away and goes flying into the air, in which case the spectators may also be injured.

The problem of a spring pulling away from a bed is especially acute in the case of outdoor trampolines because the ultraviolet rays of the sun deteriorate the nylon thread usually used to sew the tapes for the spring anchors to the flexible bed which itself is usually composed of woven polypropylene fibers which are much more resistent to the effects of the sun. The problem is accentuated because of the fact that polypropylene thread cannot be used in sewing the tapes to the bed because it does not have the strength of nylon although it is more resistant to the sun. Nylon can be made more resistant to ultraviolet rays if it is coated with an appropriate material, but the material used for this coating is soluble in contact with the oil which must be used with the large needles required to sew trampoline beds. The machines which perform this sewing are usually equipped with an oil reservoir into which the needles are continually dipped to keep them lubricated.

Accordingly, it is an object of this invention to provide an arrangement for attaching the spring anchor tapes to the bed in such a way that the effect of the sun's rays on the thread is minimized.

Another object of the invention is to attach the spring anchor tapes to the bed indirectly by means of an intermediate tape which extends along the marginal area of the bed in an arrangement such that if an anchor tape and a portion of the intermediate tape pulls away from the bed the remaining tape attached to the bed absorbs the force and holds the weakened portion for a sufficient time to prevent injury to the acrobat.

Another object of the invention is to minimize the possibility of injuries by arranging the anchor tapes inwardly of the edges of the bed so that the spring anchors and the open ends of the springs connected thereto are covered by the marginal areas of the bed itself.

A further object of the invention is to provide a sturdier support for the resilient pads which are used to cover the trampoline frame and the springs connected thereto.

Other objects and advantages will become apparent from the following detailed description of the invention, taken in conjunction with the accompanying drawings, in which:

FIG. 4 is a perspective of one of the pads before it has been placed in position over the springs;

FIG. 5 is a perspective illustrating a clamping member which is used with the pads;

FIG. 6 is a perspective detail view illustrating the manner in which the anchor tapes are stitched to the intermediate tape which is then stitched to the bed;

FIG. 7 is an enlarged fragmentary elevational view illustrating a pad positioned over the springs which are secured to the frame, with the pad in elevated position;

FIG. 8 is a fragmentary perspective of the underside of one end of one of the pads and illustrating a pair of frame-holding brackets which may be used in substitution of or in addition to the pad holding device which is illustrated in FIGS. 4 and 5; and FIG. 9 is an elevational view of one of the pads with the brackets shown in FIG. 8 after it has been attached to the frame.

Figure 1:
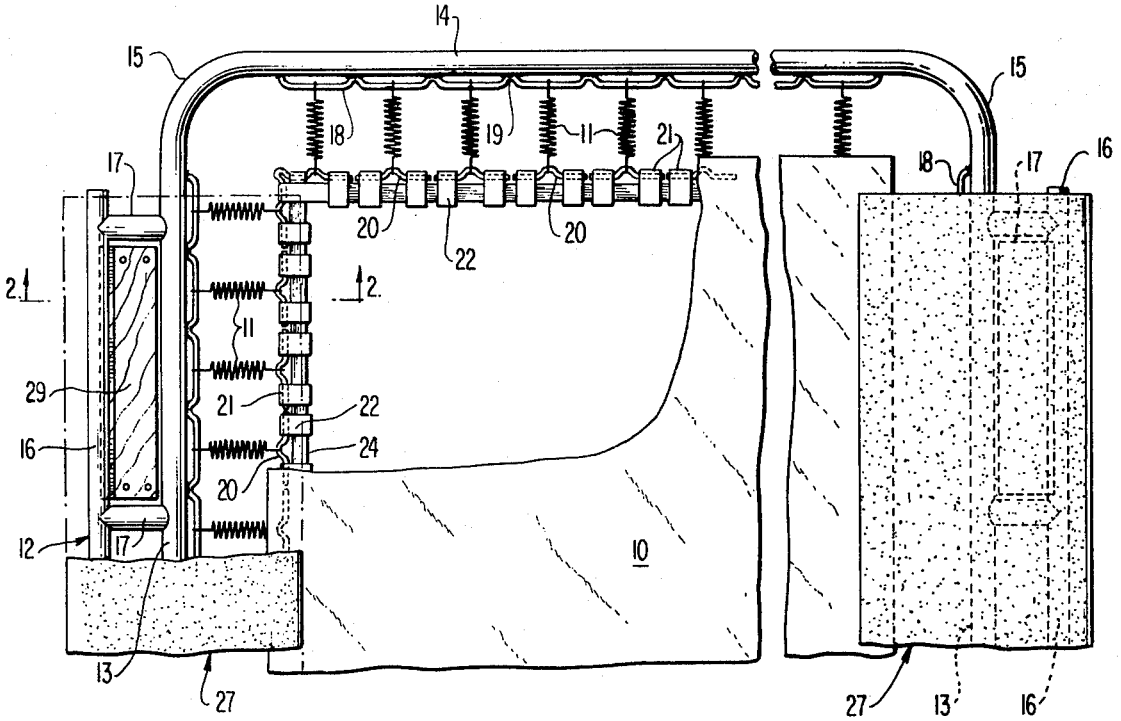
FIG. 1 is a fragmentary partially broken-away plan view of an improved trampoline according to the present invention.

In the drawings the numeral 10 indicates a trampoline bed of conventional manufacture which may comprise a rectangular sheet of flexible sheet material, for example, fabric such as heavy cotton or canvas or a closely woven fabric composed of synthetic fibers such as polypropylene, or other substantially non-stretching fibrous material. As is customary, the bed is supported in a horizontal plane by a plurality of resilient members, such as coiled springs 11, spaced at intervals around the margins of the bed and connected at their outer ends to the trampoline frame, indicated generally by numeral 12.

This frame encircles the bed and comprises an inner section formed from heavy metal tubing to form side sections 13 and end sections 14 (only one of which is shown in the drawings) which may consist of a single tube bent to form rounded corners 15, or the frame may be constructed in sections connected to be telescopically fitted together or the sections may be hinged to allow the trampoline to be dismantled for storage or travelling, as is well known in the art.

Along each side there is provided a second metal tubular member 16, spaced outwardly from the tubing 13 and connected to it by cross members 17 at spaced intervals. While the outer member could be extended around the entire periphery of the frame, it is not essential because in the case of an elongated bed the heaviest forces in the springs 11 are exerted generally in the central area of the bed against the side members of the frame.

As disclosed and claimed in my parent application Ser. No. 201,376, the inner members 13 and 14 are provided with rods 18, formed at intervals with loops 19 which can be welded to the frame to space the remainder of the rod away from the frame to provide anchorages for the outer ends of the springs 11 which allows each spring to individually slide along the rod until it finds a position to maintain it at right angles to the margins of the bed. The rod therefore, not only strengthens the frame to some extent but, by allowing for individual positioning of each spring, eliminates a serious safety hazard known to trampoline acrobats as "bed dance". Briefly stated, this is a phenomenon which produces in the acrobat's mind the illusion that the bed is horizontally unstable.

The inner end of each of the coil springs is connected to a metal anchor rod 20, the respective ends of which are received in the looped ends 21 of pairs of doubled over fabric tapes 22, as is conventional practice. It has also been the practice, in the past, to sew the doubled over ends of these tapes directly to the hem 23 of the bed in such a position that the looped ends 21, as well as the anchors and the spring ends, project outwardly beyond the edges of the bed, as shown in the above-mentioned application Ser. No. 201,376.

The present invention differs from that disclosed in said prior application in that the tapes 22 are indirectly secured to the trampoline bed and their locations have been changes so that the anchors 20, with the attached ends of the springs 11, are concealed underneath the marginal area of the bed. Thus, the possibility of injury to an acrobat who lands with one foot beyond the edge of the bed is substantially eliminated.

As can be clearly seen in FIG. 6, the short lengths of tapes 22 are first doubled over at least once to form looped ends 19, after which they are laid transversely upon one face of a second, longer, length of tape 24 with their looped portions in alignment along one side at intervals sufficient to allow pairs of tapes 22 to receive the respective ends of the metal anchors 20 and then the tapes 22 are sewed to the elongated tape 24 by means of one or more rows of stitches 25. The anchors need not necessarily be inserted in the loops at that time, nor do they need to be inserted until the bed is to be connected to the springs.

When this preliminary sewing is completed, the tape 24 is placed on the lower face of the bed 10, adjacent the inwardly turned hem 23 and again one or more rows of stitches 26 are used to secure the tape 24 to the bed. While the hem 23 may be sewed prior to the application of the tape, this need not necessarily be done as a separate operation and, while the stitches used to secure the transverse tapes to the long tape are shown as being spaced apart from the stitches used to apply tape 24 to the bed at uniform distances, this pattern need not necessarily be followed and it should be obvious that no particular pattern of stitching need be followed; it could be a zigzag or other irregular pattern. Also, while it is preferable to attach the tape 24 to the bed at a distance inwardly from the edge of the bed to cover the anchors and spring ends, it should be understood that the indirect attachment of the short tapes to the bed contributes an advantage to the invention which is independent of their locations.

The fact that the short tapes are attached to the main tape 24 prior to the latter's attachment to the bed, added to the fact that the assembly of tapes themselves lie on the under surface of the bed, means that whatever securing means, such as the stitching 25, is employed to attach the anchor-holding tapes to the main tape, it will be unaffected either by sunlight or by the ordinary wear and tear produced by the contact of acrobats on the upper surface of the bed. In short, while the stitching 26 which holds the main tape 24 to the bed may deteriorate over a period of time, a failure of this stitching will not result in the immediate release of any of the springs 11. While a portion of the long tape 24 will pull away at the specific point where there is a failure of the stitching 26, the adjacent portions of the long tape will still hold in place and, since the stitching 25 will be completely unaffected by the failure of stitching 26, the separate anchor-holding tapes 22 will not separate from the main tape 24. While, admittedly, the separation of the main tape from the bed at any given point will allow a spring 11 at that point to pull the anchor tapes 22 outwardly from their normal positions there will not be a complete failure of support. This action can be compared to that of a line of mountain climbers connected together by a safety rope; if one slips, he will be prevented from falling more than a few feet by the safety rope.

In the prior application U.S. Pat. No. 3,767,009 an arrangement is disclosed and claimed for holding several elongated resilient safety pads, indicated generally by numeral 27, in place over the frame 12 and springs which utilizes devices which engage with the rods 18 and the tubular frame member only, and such an arrangement is satisfactory for covering the ends of the trampoline although in the drawings the end pad has been omitted.

Figure 2:
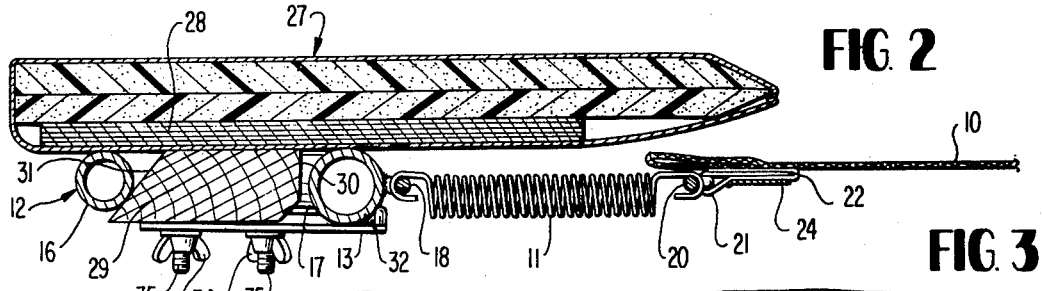
FIG. 2 is an enlarged elevational view partly in section which is taken on the line 2—2 of FIG. 1 and illustrating a pad which is positioned over the springs which are secured to the frame.
Figure 3:
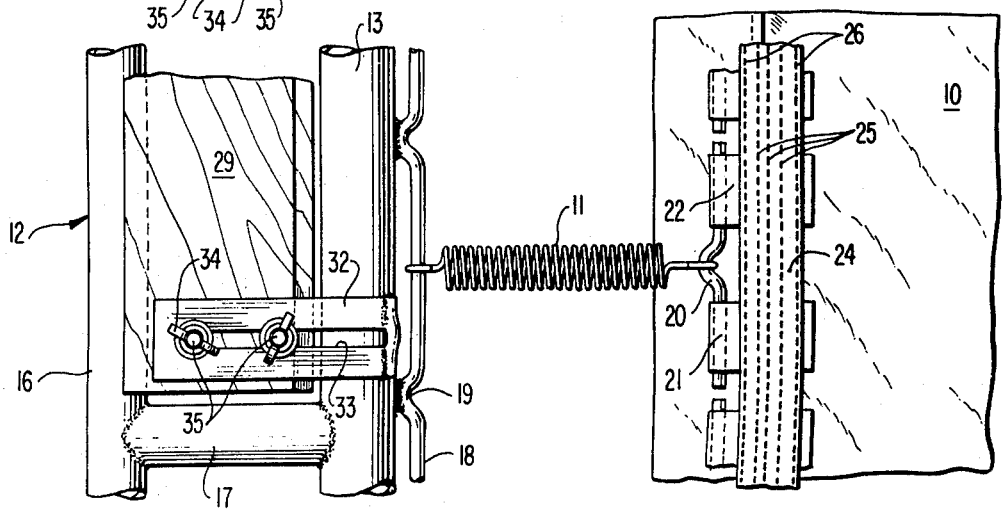
FIG. 3 is a bottom view, facing upwardly, of the showing of FIG. 2.

In the present application a sturdier arrangement is proposed for supporting the pads along the sides of the trampoline, and for this purpose the underside of the pads 27, which may comprise a rigid base such as a sheet of plywood 28, may have an elongated block 29, attached thereto the width of which is such as to loosely fit between the inner and outer members 13 and 16 and whose length is such as to fit between a pair of cross members 17. The thickness of the block should be sufficient to permit the surface 30 of one side to project downwardly at right angles to the base 28 and to abut against the outer periphery of tubular member 13 and for the opposite surface 31 to project angularly and outwardly downward below the horizontal mid plane of tubular member 16 and to abut against this member at a location below this mid plane, as shown in FIG. 2. Such an arrangement will permit the pad to be put in position by placing the surface 31 in contact with the outer tube while the pad is held in a tilted condition, as shown in FIG. 7. The pad is then lowered into the position shown in FIG. 2. Further downward movement, in a clockwise direction, is prevented because the base 28 now rests on tube 13 and angled surface 31 of the block is wedged into contact with the lower portion of tube 16.

As a precaution against accidental lifting of the pad, a metal plate 32, having an elongated central slot 33 can be attached to the underside of the block 29, as by means of a pair of wing nuts 34, secured to bolts 35 which pass through the slot 33 and are anchored in the block. When the wing nuts are loosened, the plate can be slid back, as in FIG. 7, to remove the pad.

Longitudinal movement of the pad along the frame can be prevented by making the block 29 long enough to loosely fit between the cross members 17 or, as shown in FIG. 4, two short blocks can be used, each of which engages at one end with a separate cross member.

An alternate means for securing a pad is shown in FIGS. 8 and 9, wherein a pair of heavy metal brackets 36 are attached by screws 37 to the base 28. One end 38 of each bracket extends downwardly at right angles to abut against frame member 13, while the other end 39 is curved to partially enclose the lower surface of frame member 16. Insertion and removal of the pad is accomplished in the same manner as previously described.

I claim:

1. In a trampoline of the type comprising a flexible bed supported in horizontally stressed taut condition by a plurality of coil springs connected between the margins of the bed and an encircling metal frame means, the improvement which includes a pair of parallel horizontally spaced tubular members comprising at least a portion of said frame means, one of said tubular members including means to secure the outer ends of said coil springs at spaced intervals along the length thereof, the other tubular member being rigidly secured to the one tubular member by a plurality of cross members, an elongated resilient protective pad, and means to detachably secure said pad to said pair of tubular members in horizontal position to cover said tubular members and to overhang at least the outer portions of the springs connected to the one tubular member and to prevent downward tilting movement of the pad into contact with the springs.

2. The invention according to claim 1, wherein said means to detachably secure said pad to said pair of tubular members comprises a flat, horizontal support means attached to the pad to rest on said members, and wedging means attached to the underside of said support means between said pair of parallel tubular members to engage with said tubular members to prevent said downward tilting movement.

3. The invention according to claim 2, wherein said wedging means comprises an elongated block member which also engages with at least one of said cross members to limit movement of the pad along the length of said frame.

4. The invention according to claim 2, wherein said wedging means includes means to abut against the inner surface of the first tubular member at about the level of a horizontal diametrical plane, and also includes means to abut the inner surface of the other tubular member at a level below the level of a horizontal diametrical plane, whereby the pad is placed in position by rotation about said other tubular member.

5. The invention according to claim 2, wherein said wedging means comprises an elongated block having a vertical face on one side and a downwardly and outwardly angled face on the other side.

6. The invention according to claim 5, wherein said block extends between two of said cross members, the ends thereof abutting against said cross members to limit lengthwise movement.

7. The invention according to claim 6, wherein said pad also includes means to lock the pad in position when in place on said tubular members.

8. The invention according to claim 7, wherein said locking means comprises an elongated element, and means to mount said element on said block for movement between a first position underlying said first tubular member and a second position to clear said first tubular member.

9. The invention according to claim 4, wherein said wedging means comprises an elongated metal strap secured to the underside of said flat support means parallel to said cross members, the respective ends of the strap projecting downwardly for said abutment with the respective tubular members.

10. The invention according to claim 9, wherein the end of said strap which abuts against said other tubular member terminates in an arcuate section.

* * * * *